US005592269A

United States Patent [19]

Younes et al.

[11] Patent Number: 5,592,269

[45] Date of Patent: Jan. 7, 1997

[54] IMAGING SYSTEM HAVING AN INTERMEDIATE TRANSFER MEMBER

[75] Inventors: Hani Younes, Ara; Ilan Kander, Ranana; Dorron Levy, Tel Aviv; Yossi Cohen, Rehovot; Haim Belinkov, Rishon Le Zion, all of Israel

[73] Assignee: Indigo N.V., Rotterdam, Netherlands

[21] Appl. No.: 128,149

[22] Filed: Sep. 29, 1993

[30] Foreign Application Priority Data

| | | | |
|---|---|---|---|
| Mar. 26, 1993 | [IL] | Israel | 105185 |
| Apr. 1, 1993 | [IL] | Israel | 105269 |

[51] Int. Cl.[6] ..... G03G 15/10; G03G 15/11; G03G 15/16

[52] U.S. Cl. ..... 399/237; 399/308

[58] Field of Search ..... 355/256, 271, 355/277, 279

[56] References Cited

U.S. PATENT DOCUMENTS

| | | | |
|---|---|---|---|
| 3,318,212 | 5/1967 | Rubin | 355/281 |
| 3,591,276 | 7/1971 | Byrne | 355/290 X |
| 3,795,033 | 3/1974 | Donnelly | 492/56 |
| 3,863,603 | 2/1975 | Buckley et al. | 355/251 |
| 3,893,761 | 7/1975 | Buchan et al. | 355/272 |
| 3,959,574 | 5/1976 | Seanor et al. | 492/56 |
| 4,341,455 | 7/1982 | Fedder | 355/274 |
| 4,430,412 | 2/1984 | Miwa et al. | 430/126 |
| 4,453,820 | 6/1984 | Suzuki | 355/279 |
| 4,518,976 | 5/1985 | Tarumi et al. | 355/279 X |
| 4,531,825 | 7/1985 | Miwa et al. | 355/279 |
| 4,684,238 | 8/1987 | Till et al. | 355/275 |
| 4,690,539 | 9/1987 | Radulski et al. | 355/256 X |
| 4,708,460 | 11/1987 | Langdon | 355/271 |
| 4,755,849 | 7/1988 | Tarumi et al. | 355/290 |
| 4,794,651 | 12/1988 | Landa et al. | 430/110 |
| 4,796,048 | 1/1989 | Bean | 355/277 |
| 4,833,058 | 5/1989 | Hirano et al. | 430/120 |
| 4,984,025 | 1/1991 | Landa et al. | 355/274 |
| 5,001,030 | 3/1991 | Valk | 430/126 X |
| 5,028,964 | 7/1991 | Landa et al. | 355/273 |
| 5,047,808 | 9/1991 | Landa et al. | 355/277 |
| 5,148,222 | 9/1992 | Lior et al. | 355/256 |
| 5,166,734 | 11/1992 | Pinhas et al. | 355/273 |

FOREIGN PATENT DOCUMENTS

| | | |
|---|---|---|
| 0247838 | 12/1987 | European Pat. Off. . |
| 0364855 | 4/1990 | European Pat. Off. . |
| 90/04216 | 4/1990 | WIPO . |
| 90/08984 | 8/1990 | WIPO . |
| 9014619 | 11/1990 | WIPO . |
| 91/03006 | 3/1991 | WIPO . |
| 91/03007 | 3/1991 | WIPO . |
| 9210793 | 6/1992 | WIPO . |
| 9213299 | 8/1992 | WIPO . |

OTHER PUBLICATIONS

English language abstract of Japanese Patent Publication No. 4–009087.

English language abstract of Japanese Patent Publication No. 3–243973.

English language abstract of Japanese Patent Publication No. 59–129888.

*Primary Examiner*—Fred L. Braun

*Attorney, Agent, or Firm*—Greenblum & Bernstein P.L.C.

[57] ABSTRACT

An intermediate transfer member having a release surface suitable for receiving liquid toner images which include toner particles and a hydrocarbon carrier liquid from a first surface and for transferring them to a second surface, wherein the release surface includes a silicone material, preferably, a oxime cured silicone rubber. Imaging apparatus incorporating the member preferably includes a device for removing excess carrier liquid from the silicone material after an image is transferred to the second surface.

27 Claims, 2 Drawing Sheets

FIG. 1
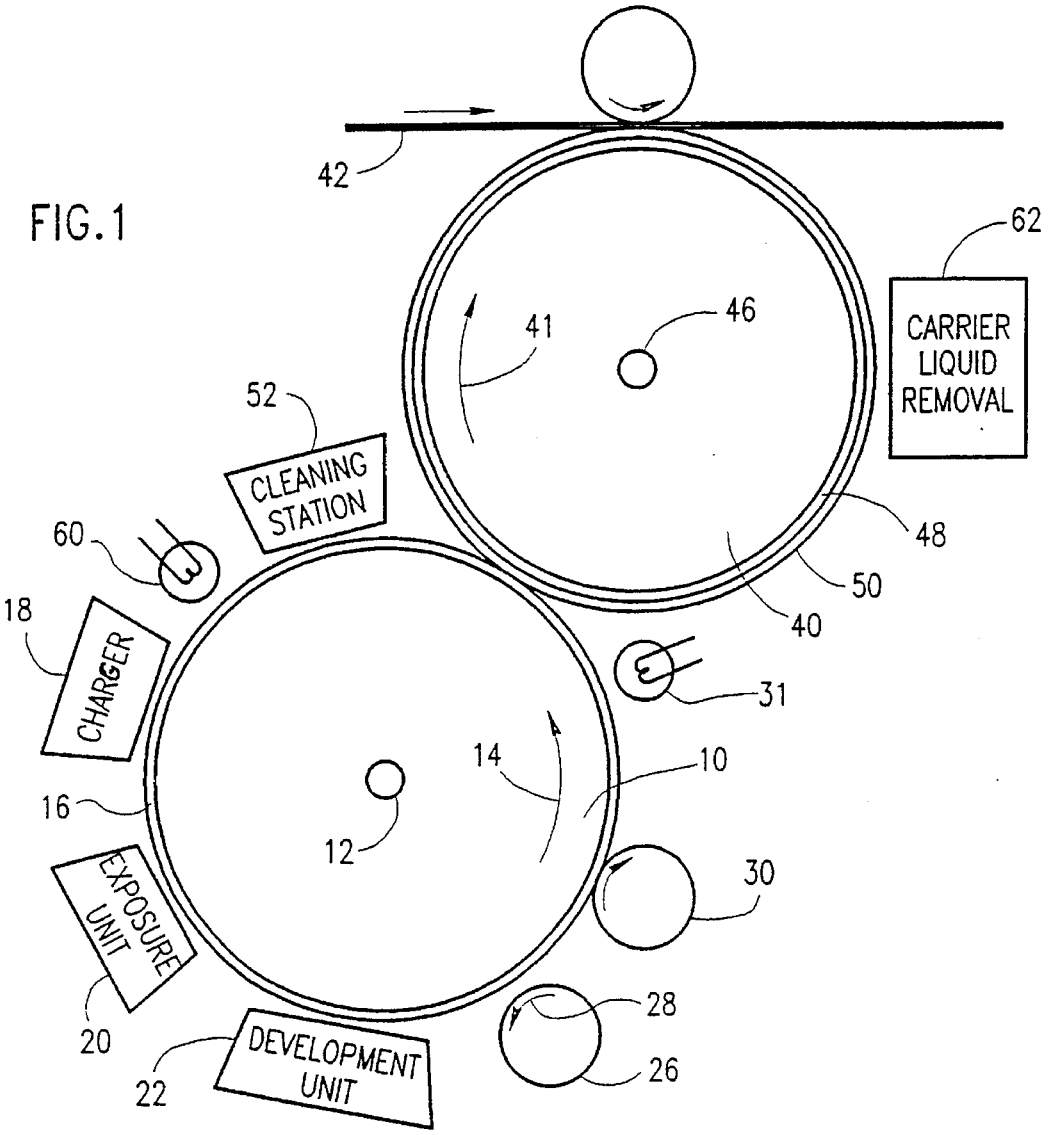
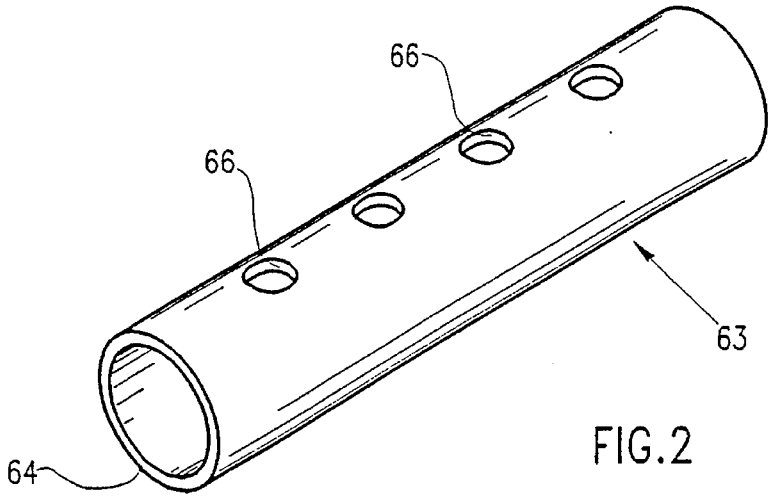
FIG. 2

IMAGING SYSTEM HAVING AN INTERMEDIATE TRANSFER MEMBER

FIELD OF THE INVENTION

The present invention relates to imaging apparatus in general and, more particularly, to liquid toner imaging apparatus which employs an intermediate transfer member for transfer of images from an imaging surface to a final substrate.

BACKGROUND OF THE INVENTION

Imaging systems which utilize intermediate transfer members are well known.

U.S. Pat. No. 5,047,808, which is commonly assigned with the present application and which is incorporated herein by reference, describes a liquid toner imaging system having an intermediate transfer member with a silicone rubber release coating.

PCT publication WO 90/14619, which is commonly assigned with the present application and which is incorporated herein by reference, describes a liquid toner system having an intermediate transfer member with a silicone rubber coating. The images are heated on the intermediate transfer member to a temperature at which the polymer in the toner particles solvates the carrier liquid and is thereby plasticized. The image, including the liquid carrier therein, is transferred in its plasticized state to the final substrate.

PCT publication WO 92/10793, which is commonly assigned with the present application and which is incorporated herein by reference, describes a liquid toner imaging system in which the intermediate transfer member is cooled after transfer of the toner image therefrom to the final substrate. The reason for such cooling is to avoid damage to the photoreceptor during transfer of the next image to the intermediate transfer member. The intermediate transfer member has a silicone rubber release coating.

U.S. Pat. No. 4,453,820 to Suzuki describes a powder toner imaging system in which the toner is heated to a fusion or melting point on an intermediate transfer member and in which, for high speed operation, the intermediate transfer member is cooled, to avoid damage to the photoreceptor.

PCT publication WO 90/04216, which is commonly assigned with the present application and which is incorporated herein by reference, shows a liquid toner imaging system in which the liquid toner image is at an elevated temperature during transfer of the image from the photoreceptor to the intermediate transfer member.

U.S. Pat. No. 3,795,033 to Donnelly et al describes a fuser roller for fusing liquid toner images which is coated with a silicone elastomer.

SUMMARY OF THE INVENTION

The present invention seeks, in certain of its aspects, to reduce the temperature of intermediate transfer members used in liquid toner imaging systems.

The present invention seeks, in certain of its aspects to provide a longer lasting intermediate transfer member, especially for use with liquid toner systems.

The present invention is especially useful in liquid toner imaging systems. In a preferred liquid toner system a liquid toner image is formed on an imaging surface using liquid toner comprising carrier liquid and toner particles which are substantially insoluble in the carrier liquid but which solvate the carrier liquid at elevated temperatures.

Substantial amounts of liquid are preferably removed from the image while it is on the imaging surface and the image is then, preferably electrostatically, transferred to an intermediate transfer member. The image is heated on the intermediate transfer member to a temperature above the solvation temperature so as to enhance it adhesiveness and is then transferred to a final substrate. In some systems a second intermediate transfer member is interposed between the intermediate transfer member and the final substrate. Preferably, enough carrier liquid is removed from the image on the imaging surface that the image (toner particles and carrier liquid) forms a single phase at the temperature to which it is heated on the intermediate transfer member.

For multi-color images, liquid toner image layers of various colors are sequentially formed on the imaging surface and are sequentially transferred to the intermediate transfer member for subsequent transfer to the final substrate. In one embodiment the liquid layers are overlaid on the intermediate transfer member and in another embodiment the layers are sequentially transferred to the final substrate (or the second intermediate transfer layer) and are overlaid thereon. In general no further fusing and fixing of the image is required after transfer from the intermediate transfer member to the final substrate.

Depending on the toner materials used, transfer from the intermediate transfer member to the final substrate (second transfer) should be possible at relatively low temperatures in accordance with theory. However, when the intermediate transfer member is heated to these low temperatures, the overall transfer process is poor. Second transfer is clearly worse at low temperatures. It is believed that transfer to the intermediate transfer member from the image forming surface (first transfer) is also adversely effected. Thus, at an intermediate transfer member surface temperature of 85° C., images exhibited substantial squash (manifested as dot spreading) and incomplete transfer.

Furthermore, at lower temperatures the intermediate transfer member suffered from a certain amount of unexplained "memory" in which the transfer characteristics of the system were affected by the previously transferred image. Thus, even when all of the toner from the previous image was transferred from the intermediate transfer member to the final substrate, there was a certain amount of ghosting of the previous image on a new and different image. This ghosting was manifested in dot spreading in portions of the intermediate transfer member which bore toner particles on the previous cycle.

In a particular machine, if the surface temperature of the intermediate transfer member surface was above 115° C. or 120° C., there were neither dot spreading nor transfer problems. At temperatures of about 100° C., there were no transfer problems, but dot spreading caused by memory effects was still apparent. Below about 95° C., both dot spreading and transfer problems were apparent.

For high speed printers, such as that of the above described apparatus, no post second transfer cooling of the intermediate transfer member is required even at intermediate transfer member surface temperatures of 115° C–120° C., since the photoreceptor is not heated sufficiently during first transfer to cause any change in photoreceptor characteristics or any damage to the photoreceptor. Furthermore, the photoreceptor is cooled to avoid problems of overheating so no cooling of the intermediate transfer member is required by the system as was required in the prior art references noted above.

It has been found, however, that the abrasion resistance of the intermediate transfer member is considerably reduced as its temperature is raised in the presence of carrier liquid such as Isopar. It is expected that the life of the member may be shortened when its temperature is raised to the higher temperature at which transfer is satisfactory, or even to the temperature at which transfer problems disappear.

The present invention is based on a new understanding of the process of successful first and second transfer, which allows for reduction of the surface temperature of the intermediate transfer member to the surface temperature actually required for second transfer. At this lower temperature, which can be as low as 60° C. to 70° C., but is preferably 85° C. to 95° C,, the lifetime of the intermediate transfer member is markedly improved. Furthermore, since the cohesivity of the toner is higher at the lower temperatures, transfer of the image from the intermediate transfer member should be more complete at the lower temperatures.

Some experiments show that both major failure modes of the intermediate transfer member, i.e., loss of release properties and loss of resilience appear to have a strong dependence on temperature, at least above some particular temperature.

It should be understood that, as a practical matter, the core of the intermediate transfer member is substantially hotter than its surface. During idle periods or paper jams the surface temperature can rise markedly, so that reduction of the required surface temperature, which carries with it a reduction of the core temperature, is an important consideration.

Applicants believe that during first transfer at least some of the carrier liquid, which is present in the liquid toner image in relatively large amounts (about 50–75 percent carrier liquid in the image areas after liquid removal by an electrified squeegee roller), is absorbed by a silicone release coating on the intermediate transfer member. While the amount of liquid which is absorbed is small, this liquid absorption causes the viscosity of the image to increase enough so that the image resists any tendency to squash during first transfer.

However, if the lower temperature for the intermediate transfer member is used, the liquid which was absorbed by the very thin silicone release layer apparently remains in the layer when the image is transferred to the final substrate. When the intermediate transfer member is operated at low temperatures, the liquid which remains in the silicone layer reduces or inhibits further absorption of liquid from the next transferred image. Furthermore, it appears that the amount of liquid remaining in the release layer (and hence the amount which acts to reduce liquid absorption in the next image transfer) is different for print and non-print areas of the image, resulting in the aforementioned ghosting.

This retention of liquid in the image appears to have a strongly deleterious effect on second transfer as well. It is believed that, when the amount of liquid in the image is decreased, the toner particles more easily form a single phase with the liquid at a lower temperature than if there is an excess of carrier liquid. When the image is in a two phase situation, squash can more easily occur since the toner particles are somewhat free to move in the excess liquid. When the toner is in a single phase, all of the liquid is absorbed by the toner particles and movement of the particles during second transfer is less likely.

Furthermore, complete second transfer is enhanced by increased viscosity of the image. When the particles are contained in unsolvated (free) liquid, the overall viscosity of the image is reduced and splitting of the image and incomplete transfer may result. However, the viscosity of the toner particles themselves does not depend on the excess carrier liquid so that transfer to the final substrate is not adversely affected when the excess liquid is removed.

In some aspects of the present invention, means are provided for removing absorbed liquid from the intermediate transfer member after second transfer and before subsequent first transfer of a subsequent image.

One way to remove this carrier liquid is by heating the intermediate transfer member during the period between second transfer and first transfer of the subsequent image. This was apparently the major positive effect of heating the intermediate transfer member to above 115° C. to 120° C. as described above.

The present inventors have also found that when air at room temperature is blown over the surface of the intermediate transfer member downstream of second transfer, the vapor pressure of the carrier liquid is reduced and removal of the minute amounts of carrier liquid in the release layer is effected. Blowing heated air over the surface of the intermediate transfer member has the same salutory effect as using room temperature air. When air is blown over the surface, the surface temperature of the intermediate transfer member can be reduced to 95° C. with no problems. For lower temperatures, carrier liquid removal is low even when air is blown on the surface after second transfer.

In a further embodiment of the invention, oxime cured silicone rubber is used as the outer release layer of the intermediate transfer member. It has been surprisingly found that such oxime cured materials have much longer life than silicone rubber cured by other systems. Such oxime cured rubbers in general do not appear to require any fillers for strengthening as do other materials and as was previously believed was required, although filled material can be used.

It is believed that this longer life of the oxime cured systems is based on improved retention of their release properties when attacked by ozone, which is produced during the operation of most electrostatographic copiers and printers.

BRIEF DESCRIPTION OF THE DRAWINGS

The present invention will be better understood from the following detailed description of preferred embodiments, taken in conjunction with the following drawings of which:

FIG. 1 is a simplified schematic sectional illustration of a liquid toner image system in accordance with a preferred embodiment of the invention;

FIG. 2 is a perspective drawing of an air distributor in accordance with a preferred embodiment of the invention.

DETAILED DESCRIPTION OF THE PREFERRED EMBODIMENTS

Figure 3:
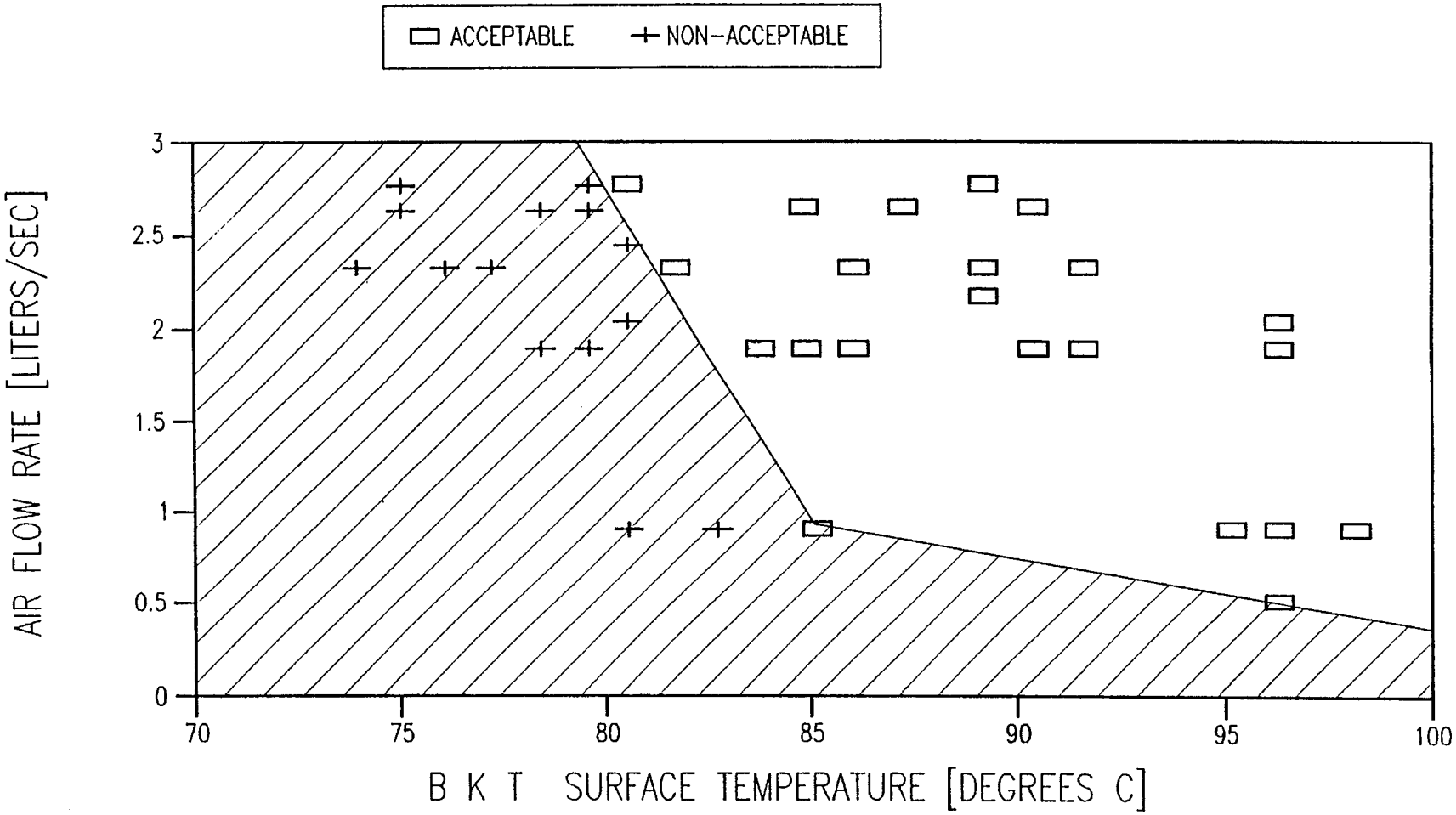
FIG. 3 is a graph showing the effect of removing entrapped carrier liquid from a silicone rubber release layer of an intermediate transfer member on the required temperature of the member.

FIG. 1 shows a preferred electrostatographic system in accordance with a preferred embodiment of the invention. The preferred system utilizes a drum 10 formed with a cylindrical image forming surface such as a photoreceptor surface 16, arranged for rotation about an axle 12 in a direction generally indicated by arrow 14.

A charger 18 such as, for example, a corona discharge device, is operative to generally uniformly charge photoreceptor surface 16 with a charge of a given polarity. Continued rotation of drum 10 brings charged photoreceptor surface 16 into image receiving relationship with an exposure unit 20. Unit 20 focuses a desired image, which may be laser generated, onto charged photoreceptor surface 16, selectively discharging the photoreceptor surface, thus producing an electrostatic latent image thereon. Unit 20 may be a laser scanner, an ionographic imaging unit or may be an optical system for projecting an image of a document to be copied.

Continued rotation of drum 10 brings charged photoreceptor surface 16 bearing the electrostatic latent image into operative association with a development unit 22, which is operative to apply a liquid developer to develop the electrostatic latent image. For multicolor copying or printing, development unit 22 can, for example, comprise a plurality of developers, one for each color, which are selectively engaged with the photoreceptor, as described, for example, in U.S. Pat. No. 4,690,539, the disclosure of which is incorporated herein by reference. Alternatively a single development station where the liquid toner is changed between colors, or any other suitable development system may be used. In general, the development process takes place at a relatively low temperature, namely approximately the temperature of the environment of the system. Other preferred development systems such as those described in U.S. Pat. No. 5,148,222 are also suitable for use with the invention.

In accordance with preferred embodiments of the invention, liquid toners comprising toner particles, preferably particles having fibrous extensions, and carrier liquid are utilized in development unit 22. Types of liquid toner which are especially useful in the practice of the invention are described in U.S. Pat. No. 4,794,651, the disclosure of which is incorporated herein by reference. Preferably, solvating liquid toner, comprising carrier liquid and toner particles which are substantially insoluble in the liquid and which solvate the liquid at elevated temperatures, as described in U.S. Pat. No. 4,794,651 is used.

In accordance with a preferred embodiment of the invention, following application of toner thereto, photoreceptor surface 16 passes a typically positively charged rotating roller 26, preferably rotating in a direction indicated by an arrow 28. Roller 26 functions as a metering roller and reduces the thickness of liquid on photoreceptor surface 16. Typically the spatial separation of roller 26 from photoreceptor surface 16 is about 50 to 70 micrometers.

Preferably the voltage on roller 26 is intermediate the voltages of the latent image areas and the background areas on the photoreceptor surface. Typical voltages are: roller 26: −200 V, background area: about −1000 V and latent image areas: about −150 V.

When a reverse roller type developer is used, roller 26 is generally unnecessary, except that, in certain high speed systems, a negatively charged roller as described in PCT publication WO 92/13299 may be used to remove toner particles on the background.

Liquid which passes roller 26 (or the reverse roller developer) should be relatively free of pigmented particles except in the region of the latent image.

Downstream of roller 26 ( or the reverse roller developer) there is preferably provided a rigidizing roller 30. Rigidizing roller 30 is preferably formed of a resilient polymeric material, such as conductive resilient polymeric material as described in either or both of U.S. Pat. Nos. 3,959,574 and 3,863,603. Roller 30 is preferably resiliently urged against photoreceptor surface 16.

In a preferred embodiment of the invention, a rigidizing roller 30 operates as a biased squeegee roller. Roller 30 is negatively charged to a potential of at least several hundred and up to 2000 volts with the same sign as the charge on the pigmented toner particles, so that it repels similarly charged pigmented particles and causes them to approach the image areas of the photoreceptor surface 16 more closely, thus compressing and rigidizing print areas of the image and facilitating the removal of liquid therefrom and from background (non-print) areas. Use of such rigidizing rollers to remove liquid from images is described in U.S. Pat. No. 5,028,964.

The image next passes a pre-transfer irradiation station, preferably comprising a light source 31. Use of pre-transfer erase for discharging photoreceptors in reversal developed imaging is taught in U.S. Pat. No. 5,166,734, the disclosure of which is incorporated herein by reference.

Downstream of rigidizing roller 30 there is provided an intermediate transfer member 40, which rotates in a direction opposite to that of photoreceptor surface 16, as shown by arrow 41, providing substantially zero relative motion between their respective surfaces at the point of propinquity. Intermediate transfer member 40 is operative for receiving the toner image from photoreceptor surface 16 and for transferring the toner image to a receiving substrate 42, such as paper. Disposed internally of intermediate transfer member 40 there may be provided a heater 46. The image on the intermediate transfer member may also be heated by an external heater prior to its transfer from the intermediate transfer member. In a preferred embodiment of the invention the intermediate transfer member comprises a soft layer 48 which is coated with a release coating layer 50.

Various types of intermediate transfer members are known and are described, for example in U.S. Pat. No. 4,984,025; 5,047,808 and in assignee's co-pending U.S. patent application Ser. No. 7/293,456 filed Jan. 4, 1989, the disclosures of which are incorporated herein by reference. While the intermediate transfer member is shown as a solid drum coated with an intermediate transfer layer, a removable intermediate transfer blanket or a belt type intermediate transfer member may also be used in the practice of the invention.

Preferably, the intermediate transfer member is electrically biased to attract the charged toner particles from the photoreceptor surface.

The intermediate transfer members which are especially useful in some of the preferred embodiments of the invention utilize silicone rubber or silicone release coating material as the release coating 50. Such materials are generally polydimethyl siloxanes with or without phenyl.

In an especially preferred embodiment of the invention, silicone rubbers which are oxime cured (preferably containing ketoxime groups as a cross-linking agent) are used as the release coating. These oxime cured materials generally have less extensive utility and are less widely available than materials utilizing other cure systems. However, in the present application as a release coating for intermediate transfer members, they have a very long life compared to silicone rubbers having other cure systems. The present inventors believe that oxime cured silicone rubbers are more ozone resistant than other silicone rubbers. Due to the presence of substantial concentrations of ozone in imaging systems of the type of the invention, this characteristic is of great importance.

In a preferred embodiment of the invention, soft layer 48 underlies the release layer. This soft layer is preferably prepared as follows:

1—One Kg of Fomrez F50 polyurethane resin (Witco) is sintered under vacuum at 70 degrees Celsius;

2—The produce of step 1 is degassed at 120 degrees Celsius (in a hot oil bath) while being stirred under vacuum conditions. The resulting material is stored under dry storage conditions;

3—20 grams of the result of step 2, 2.2 grams of RTV silicone 118 (General Electric, USA) and 2.7 grams of polymethylane diphenyl isocyanate are stirred together; and 4—A 100 micrometer thick layer of the results of step 3 is coated on the lower layers of the intermediate transfer layer using a Bar #3 wire rod with three passes under clean conditions (class 100). The soft layer is cured for 16 hours at room temperature under clean conditions, followed by two hours at 130 degrees Celsius. Alternatively, the material is cured at 70 degrees Celsius for ten minutes, followed by two hours at 130° C.

Preferably, this soft layer is coated onto a compressible layer such as known in the art.

In a preferred embodiment of the invention the silicone release coating is prepared and coated onto the intermediate transfer member by the following method.

1—12 grams of RTV Silicon 236 (DOW CORNING) is diluted with 2.0 grams of Isopar L and 0.72 grams of Syl-Off 297 (DOW CORNING). This material is oxime cured; and 2—A wire rod (bar #1) coating system is used, with three passes, under class 100 clean conditions to achieve a 7±1 micrometer release layer thickness. The material is cured at 150 degrees Celsius for two hours.

Other oxime cure system materials are also utilized in preferred embodiments of the invention. Such materials include Nu-Sil R-1007, R-1008, R-1009, R-1010, R-1030, R-1048, R-1075, R-1130, R-1600, R-1505, CV-1142, CV-1142-2, CV-1143, CV-1143-1, CV-1144-0, CV-1144-2, CV-1152 and CV-1500 oxime cured silicone materials marketed by McGhan NuSil Corporation of Carpintera, California.

While these oxime cured materials are most preferred, other materials such as Syl-Off 294 and other silicone rubbers are also useful as release layers for intermediate transfer members.

Following the transfer of the toner image to intermediate transfer member 40, photoreceptor surface 16 preferably engages a cleaning station 52. This station may be any conventional cleaning station, including a cleaning roller which may comprise a suitable resilient material such as foam polyethylene or neoprene. The cleaning roller may be wetted by clean lubricating cleaning liquid, which preferably comprises liquid developer from which all or nearly all of the toner particles have been removed. The use of a cooled clean liquid in the cleaning station also has the desired effect of cooling the photoreceptor and avoiding temperature creep of the photoreceptor due to its contact with the intermediate transfer member. The cleaning roller is driven so that its surface moves opposite to surface 16 at their nip, to provide scrubbing action for removal of residual particles and carrier liquid from photoreceptor surface 16. An optional scraper completes the removal of any residual toner which may not have been removed by the cleaning roller.

A lamp 60 completes the cycle by removing any residual charge, characteristic of the previous image, from semiconductor surface 16.

While a lamp 60 is conventional, the present inventors have found that, at least for reversal development, when pre-transfer irradiation is used together with an electrified intermediate transfer member, lamp 60 is not generally required. In this case, the pre-transfer irradiation followed by the positive electrification of the photoreceptor by the intermediate transfer member act to make such discharge inoperative. The use of a scorotron as charger 18, for charging the photoreceptor, is indicated in such situations.

Transfer of the image to intermediate transfer member 40 is preferably aided by providing electrification of intermediate transfer member 40 to a voltage generally having a polarity opposite to that of the charged particles, thereby causing electrostatic transfer of the particles to the intermediate transfer member. A portion of the carrier liquid is also transferred to the intermediate transfer member.

Subsequent final transfer of the image from intermediate transfer member 40 to substrate 42 is preferably aided by heat and pressure. A higher temperature than that used for first transfer is preferably utilized for this subsequent final transfer, in accordance with the present invention.

In the present invention the preferred second transfer step, i.e., the transfer of the liquid toner image to the final substrate, includes the heating of the image before and/or during second transfer. This further heating can be achieved by heating the image on intermediate transfer member 40, for example by heat transfer from intermediate transfer member 40 during the interval between first and second transfer and/or by external heating of the image. Alternatively or additionally the further heating can be achieved by conduction heating of the image from the substrate during second transfer.

For multicolor systems, in accordance with a preferred embodiment of the invention, the individual color images are first transferred to the intermediate transfer member and then transferred, in aligned configuration, separately, to the final substrate. Alternatively it may be useful to sequentially transfer the separate colors to intermediate transfer member 40 in alignment with and generally superimposed on and in registration with each other and then to transfer them together to paper or other substrate 42.

It is a characteristic of silicone rubber materials and of silicone release coatings that such materials solvate large amounts of the hydrocarbon liquids generally used as carrier liquids in liquid toners. When silicone materials solvate carrier liquid they become swollen. Nevertheless, it has been surprisingly found that coating an intermediate transfer member with such materials which absorb or solvate carrier liquid (especially when the outer layer is thin) results in improved transfer of the image from the photoreceptor to the intermediate transfer member and from the intermediate transfer member to the final substrate. Preferably, such layers should have a thickness less than three millimeters and more than 2 micrometers, with 2–3, 7, 10 and 100 micrometers and two millimeters being representative values.

It should be understood that, while the surface layer absorbs the liquid, the surface layer is preferably a nonporus, smooth layer. The absorption of the liquid is accomplished by swelling of the surface layer.

It has been a goal of the prior art to remove excess liquid from liquid toner images before or during transfer of the image to the final substrate. This is useful for reducing squash during transfer. Transfer to a smooth surfaced intermediate transfer member generally will not result in any drying of the image and related rigidizing. However, when the release coatings of the present invention are used, nearly instantaneous drying of the image during transfer to the intermediate transfer member occurs resulting in more squash free transfer of the image.

In some cases when subsequent copies are made at short intervals and new images are transferred to the intermediate transfer member, the advantageous effects of the coating are apparently reduced. This is believed to be the result of carrier liquid which remains in the release layer and reduces the amount of liquid which is absorbed in subsequent transfers.

There is therefore provided, in a preferred embodiment of the present invention, means 62 for removing carrier liquid absorbed by the release layer of an intermediate transfer member after transfer of an image therefrom.

In one embodiment the means for removing comprises a fan which blows air onto the surface of the intermediate transfer member. This flow of air reduces the vapor pressure of the carrier liquid at the surface of the intermediate transfer member and aids in evaporation of the absorbed liquid carrier therefrom. Generally, this air flow is at room temperature; but, heated air works equally well in the present invention.

While it is known, at least in the powder toner art, to cool intermediate transfer members before they contact the photoreceptor, to avoid damage to the photoreceptor; in the present invention, such air flow is applied even when the temperature of the intermediate transfer member and amount of time which it contacts the photoreceptor are such that no damage to the photoreceptor would result. Furthermore, for the air flow rates described below, measurements have shown that no appreciable cooling of the intermediate transfer member occurs.

Further, the end result of the practice of the invention is to reduce the amount of heating of the intermediate transfer member so that, even during second transfer, the member operates at a lower temperature than would otherwise be required. This is best understood by realizing that heating the intermediate transfer member to a higher temperature than is actually required for good second transfer also acts to remove absorbed carrier liquid from the absorbent surface.

FIG. 2 shows a preferred embodiment 63 of an air flow device 62 for blowing air on the photoreceptor. Device 63 comprises a capped hollow tube 64 which is pierced by a plurality of holes 66 along its length. These holes face the intermediate transfer member and distribute a relatively uniform flow of air on its surface. FIG. 3 shows a graph of flow rate as a function of blanket surface temperature. In this graph, operation to the right of the curve resulted in acceptable operation and operation to the left of the curve was not satisfactory, presumably because of squash on first or second transfer. The length of the tube is about 300 mm. Memory effects continued up to surface temperatures of 115° C. to 120° C.

Alternatively, in a preferred embodiment of the invention, the holes may be replaced by slots or by a single slit running the length of the device.

It is seen that the surface temperature of the intermediate transfer member can be reduced by 20°–35° C. using moderate air flows, which by themselves do not substantially decrease the intermediate transfer member's temperature. Temperature reductions of 20°–35° C. are very significant with respect to intermediate transfer member life and safety of the system in case of jams. It should be understood that internal heater 46 is generally set at a higher temperatdre (up to 60° C. higher) than the desired surface temperature. During paper jams, portions of the surface can reach this higher temperature. In addition, the photoreceptor surface temperature increases. These effects can be deleterious to future operation of the system and sometimes can be dangerous.

It is thus seen that reduction of the intermediate transfer member surface temperature has a multiplicity of beneficial effects.

While the present invention has been described with reference to the preferred embodiments thereof, the invention is defined solely by the following claims:

We claim:

1. An intermediate transfer member apparatus for an imaging machine comprising:

a release surface suitable for receiving liquid toner images comprising toner particles and a hydrocarbon carrier liquid from a first surface and for transferring them to a second surface, wherein the release surface comprises an oxime cured silicone material.

2. An intermediate transfer member according to claim 1 wherein the oxime cured silicone material comprises an oxime cured silicone rubber.

3. Imaging apparatus comprising:

an image bearing surface having a liquid toner image comprising toner particles and a hydrocarbon carrier liquid formed thereon;

an intermediate transfer member comprising:

a release surface which receives the liquid toner image from the image bearing surface and which transfers it to a further surface, wherein the release surface comprises an oxime cured silicone mateial;

a first transfer station at which the image is transferred from the image bearing surface to the intermediate transfer member; and a second transfer station at which the image is transferred from the intermediate transfer member to a further surface.

4. Apparatus according to claim 3 and also including liquid removal means, located downstream of the second transfer station, for removing carrier liquid absorbed by the release surface.

5. Apparatus according to claim 4 wherein the liquid removal means comprises means for heating the intermediate transfer member after transfer of the image from the intermediate transfer member.

6. Apparatus according to claim 4 wherein the liquid removal means comprises means for flowing a current of air along the surface of the intermediate transfer member after transfer of the image therefrom.

7. Apparatus according to claim 6 wherein the current of air does not substantially reduce the temperature of the intermediate transfer member over what it would be in its absence.

8. Imaging apparatus according to claim 3 wherein the silicone material comprises an oxime cured silicone rubber.

9. Apparatus according to claim 8 and also including liquid removal means, located downstream of the second transfer station, for removing carrier liquid absorbed by the release surface.

10. Apparatus according to claim 9 wherein the liquid removal means comprises means for heating the intermediate transfer member after transfer of the image from the intermediate transfer member.

11. Apparatus according to claim 9 wherein the liquid removal means comprises means for flowing a current of air along the surface of the intermediate transfer member after transfer of the image therefrom.

12. Apparatus according to claim 11 wherein the current of air does not substantially reduce the temperature of the intermediate transfer member over what it would be in its absence.

13. An intermediate transfer member for an imaging machine comprising:

a release surface suitable for receiving liquid toner images comprising toner particles and a hydrocarbon carrier liquid from a first surface and for transferring them to a second surface, wherein the release surface comprises an oxime cured material which absorbs and is swelled by carrier liquid.

14. An intermediate transfer member according to claim 13 wherein the release surface comprises an oxime cured silicone rubber.

15. Imaging apparatus comprising:

an image bearing surface having a liquid toner image comprising toner particles and a hydrocarbon carrier liquid formed thereon;

an intermediate transfer member comprising a release surface which receives the liquid toner image from the image bearing surface and which transfers it to a further surface, wherein the release surface comprises an oxime cured silicone material which absorbs and is swelled by carrier liquid;

a first transfer station at which the image is transferred from the image bearing surface to the intermediate transfer member; and a second transfer station at which the image is transferred from the intermediate transfer member to a further surface.

16. Apparatus according to claim 15 and also including liquid removal means, located downstream of the second transfer station, for removing carrier liquid absorbed or the release surface.

17. Apparatus according to claim 16 wherein the liquid removal means comprises means for heating the intermediate transfer member after transfer of the image from the intermediate transfer member.

18. Apparatus according to claim 16 wherein the liquid removal means comprises means for flowing a current of air along the surface of the intermediate transfer member after transfer of the image therefrom.

19. Apparatus according to claim 18 wherein the current of air does not substantially reduce the temperature of the intermediate transfer member over what it would be in its absence.

20. Imaging apparatus according to claim 15 wherein the release surface comprises an oxime cured silicone rubber.

21. Apparatus according to claim 20 and also including liquid removal means, located downstream of the second transfer station, for removing carrier liquid absorbed by the release surface.

22. Apparatus according to claim 21 wherein the liquid removal means comprises means for heating the intermediate transfer member after transfer of the image from the intermediate transfer member.

23. Apparatus according to claim 21 wherein the liquid removal means comprises means for flowing a current of air along the surface of the intermediate transfer member after transfer of the image therefrom.

24. Apparatus according to claim 23 wherein the current of air does not substantially reduce the temperature of the intermediate transfer member over what it would be in its absence.

25. Imaging apparatus comprising:

an image bearing surface having a liquid toner image comprising toner particles and a hydrocarbon carrier liquid formed thereon;

an intermediate transfer member, having a surface which absorbs and is swelled by the carrier liquid which receives the liquid toner image from the image bearing surface at a first transfer station and which transfers the image to a further surface at a second transfer station; and a source of flowing air, which flows air along the surface of the intermediate transfer member downstream of the second transfer station and which removes carrier liquid absorbed by the surface of the intermediate transfer member, wherein the flow of air does not substantially reduce the temperature of the intermediate transfer member after transfer of the image therefrom.

26. Imaging apparatus comprising:

an image bearing surface having a liquid toner image comprising toner particles and a hydrocarbon carrier liquid formed thereon;

an intermediate transfer member, having a surface which absorbs and is swelled by the carrier liquid which receives the liquid toner image from the image bearing surface at a first transfer station and which transfers the image to a further surface at a second transfer station; and liquid removal means located downstream of the second transfer station and which removes carrier liquid absorbed by the surface of the intermediate transfer member, wherein the liquid removal means does not substantially reduce the temperature of the intermediate transfer member after transfer of the image therefrom.

27. Imaging apparatus comprising:

an image bearing surface having a liquid toner image comprising toner particles and a hydrocarbon carrier liquid formed thereon;

an intermediate transfer member, having a surface which absorbs and is swelled by the carrier liquid which receives the liquid toner image from the image bearing surface at a first transfer station and which transfers the image to a further surface at a second transfer station; and a heater which heats the intermediate transfer member downstream of the second transfer station to remove carrier liquid absorbed by the surface of the intermediate transfer member.

* * * * *

UNITED STATES PATENT AND TRADEMARK OFFICE

CERTIFICATE OF CORRECTION

PATENT NO. : 5,592,269

DATED : January 7, 1997

INVENTOR(S) : H. YOUNES et al.

It is certified that error appears in the above-indentified patent and that said Letters Patent is hereby corrected as shown below:

At column 11, line 11 (claim 13, line 7), after "cured" insert ---silicone---.

Signed and Sealed this

Second Day of September, 1997

Bruce Lehman

*Attest:*

BRUCE LEHMAN

*Attesting Officer*

*Commissioner of Patents and Trademarks*